US006540605B1

(12) United States Patent
Lesage

(10) Patent No.: US 6,540,605 B1
(45) Date of Patent: Apr. 1, 2003

(54) AIR CIRCULATING METHOD AND DEVICE

(76) Inventor: Gaetan Lesage, 197 de Clèves, Laval, QBC (CA), H7M 4W4

( * ) Notice: Subject to any disclaimer, the term of this patent is extended or adjusted under 35 U.S.C. 154(b) by 0 days.

(21) Appl. No.: 10/023,663

(22) Filed: Dec. 21, 2001

(51) Int. Cl.[7] ..... F24F 7/06
(52) U.S. Cl. ..... 454/231; 454/306
(58) Field of Search ..... 454/231, 232, 454/233, 306

(56) References Cited

U.S. PATENT DOCUMENTS

| | | | | |
|---|---|---|---|---|
| 3,347,025 A | * | 10/1967 | Wiley | 96/224 |
| 3,827,342 A | | 8/1974 | Hughes | |
| 3,973,479 A | | 8/1976 | Whiteley | |
| 4,440,342 A | * | 4/1984 | Flagg | 237/50 |
| 4,961,766 A | | 10/1990 | Hogan | |
| 5,358,444 A | | 10/1994 | Helm et al. | |
| 5,403,232 A | | 4/1995 | Helm et al. | |
| 6,019,677 A | | 1/2000 | Demster | |

FOREIGN PATENT DOCUMENTS

| | | | | |
|---|---|---|---|---|
| FR | 2 486 211 | * | 1/1982 | 454/231 |

* cited by examiner

*Primary Examiner*—Harold Joyce

(57) ABSTRACT

A method for circulating the air contained within an enclosure so as to reduce the vertical air temperature stratification. The method includes the steps of positioning a piece of furniture within the enclosure so as to create an air circulating conduit. The piece of furniture is positioned so as to form at least part of the air circulating conduit. The air circulating conduit defines a circulating conduit inlet positioned adjacent a first initial air temperature level and a circulating conduit outlet positioned adjacent a second initial air temperature level. The method also involves inducing a flow of air in the circulating conduit so as to force the air adjacent the first initial air temperature level to flow into the conduit inlet and to be discharged at the conduit outlet. An air circulating device is also proposed. The air circulating device includes a piece of furniture having a furniture spacing component for spacing the furniture bottom wall from the floor. The device also includes an air blower attached to the furniture for blowing air in a direction substantially parallel to one of the walls of the furniture peripheral surface.

18 Claims, 2 Drawing Sheets

AIR CIRCULATING METHOD AND DEVICE

FIELD OF THE INVENTION

The present invention relates to the general field of air temperature management and is more particularly concerned with an air circulating method and device.

BACKGROUND OF THE INVENTION

Indoor areas or enclosures such as rooms, stocking areas, retailing areas and the like are typically maintained at a predetermined temperature by heating or cooling the air within the enclosure.

It is well known that heating reduces the density of air. This phenomenon causes the heated air to rise and to typically stagnate along the ceiling of the enclosure while cold air drops or remains adjacent to the floor of the enclosure.

As a consequence of the warm air rising and cold air descending, a temperature gradient or stratification develops. The temperature gradient is associated with a decrease in heating efficiency, a higher energy consumption and the creation of drafts and pockets of air which render the enclosure uncomfortable. Furthermore, temperature stratification results in a loss of heat through the ceiling. Indeed, it is commonly recognized that heat loss is important during winter months through the ceiling even though insulation may be present.

One particular situation wherein temperature stratification causes major problems is encountered in the field of retail stores presenting relatively large retail areas and in particular retail stores wherein refrigerated display compartments are located. These relatively large retail areas are often provided with ventilation units that are used for discharging heated air that has been previously heated by a suitable air heating device such as a furnace.

Typically, the heated air is discharged towards the floor and the display shelves of the retail area through air diffusers located adjacent the ceiling. Because of the density gradient, the warm air has a tendency to, rise before reaching the level of the display shelves. The problem is compounded when refrigerated display units are used, since they typically cool the air adjacent the floor. Hence, the warmest air occupies the stratum adjacent the ceiling and maintains a density and temperature gradient that prevents conventional diffusers from efficiently heating the room.

The problem of temperature stratification occurs with most types of heating systems including radiant heat systems and warm-air systems. Temperature stratification has long been recognized as an obstacle to efficient room temperature control and, thus, there have been many attempts in the prior art to overcome temperature stratification. Such attempts, as exemplified in U.S. Pat. No. 3,347,025 naming Wiley as inventor and U.S. Pat. No. 3,827,342 naming HUGHES as inventor have conventionally attempted to solve the problem by circulating air at one level to another level with a fan. However, this type of solution has proven to be disappointing since the fan has to discharge the flow of warm air at a relatively high flow rate in order to compensate for the stratification.

Consequently, various problems such as turbulence, noise, increased energy consumption and the like are created. Furthermore, in the case where refrigerated display shelves are contained within the room, the warm air is often projected towards the display cases thus increasing the overall energy consumption. Accordingly, there exists a need for an improved air circulation device and method.

SUMMARY OF THE INVENTION

In accordance with the present invention, there is provided a method for circulating the air contained within an enclosure so as to reduce the vertical air temperature stratification of the air, the air temperature stratification defining a first initial air temperature level and a second initial air temperature level, the first initial air temperature level being located above the second initial air temperature level, the temperature of the air being higher at the first initial air temperature level than at the second initial air temperature level, the enclosure defining an enclosure ceiling, an enclosure floor and enclosure peripheral wall, the enclosure having a piece of furniture contained therein, the piece of furniture defining a furniture top surface, a furniture bottom surface, a furniture first peripheral surface and a generally opposed furniture second peripheral surface, the method comprising the steps of: positioning the piece of furniture within the enclosure so as to create an air circulating conduit defining a circulating conduit peripheral wall; the piece of furniture being positioned so that the furniture first peripheral surface forms at least part of the air circulating conduit, the air circulating conduit being configured, sized and positioned so as to define a circulating conduit inlet positioned adjacent the first initial air temperature level and a circulating conduit outlet positioned adjacent the second initial air temperature level; inducing a flow of air in the circulating conduit so as to force the air adjacent the first initial air temperature level to flow into the conduit inlet and to be discharged at the conduit outlet.

Preferably, the positioning of the piece of furniture includes raising the furniture bottom surface from the room floor so as to create a floor-to-furniture spacing therebetween, the floor-to-furniture spacing defining a first air conduit segment extending between the furniture first and second surfaces adjacent to the room floor.

Conveniently, the piece of furniture is positioned adjacent a section of the room peripheral wall in a spaced relationship relative to the latter so as to define a room peripheral wall-to-furniture first peripheral wall spacing therebetween, the room peripheral wall-to-furniture first peripheral wall spacing defining a generally vertical air conduit second segment extending from the air conduit inlet to the air conduit first segment and being in fluid communication with the latter.

In accordance with one aspect of the invention, the piece of furniture is positioned adjacent a second piece of furniture in a spaced relationship relative to the latter so as to define a second piece of furniture-to-furniture first peripheral surface spacing therebetween, the second piece of furniture-to-furniture first peripheral surface spacing defining a generally vertically oriented air conduit second segment, the air conduit second segment extending from the air conduit inlet to the air conduit segment and being in communication with the latter.

When the room is provided with an air diffuser positioned adjacent the room ceiling, optionally, the piece of furniture is positioned so that the circulating conduit inlet is substantially in register with the diffuser.

Optionally, the flow of air is induced by providing and air blower in the circulating conduit. Typically, the air blower is positioned in the floor-to-furniture spacing. Also, typically, the air blower is positioned adjacent the circulating conduit outlet. Alternatively, the flow of air is induced by providing an air blower adjacent the circulating conduit.

In accordance with the present invention, there is also provided an air circulating device for circulating the air contained within an enclosure, the enclosure defining an enclosure ceiling, an enclosure floor and an enclosure peripheral wall, the air circulating device comprising: a piece of furniture, the piece of furniture defining a furniture peripheral surface including a furniture top wall, a furniture bottom wall, a furniture first peripheral wall and a furniture second peripheral wall; a floor-to-furniture spacing means for spacing the furniture bottom wall from the floor; and an air blower attached to the furniture for blowing air in a direction substantially parallel to one of the walls of the furniture peripheral surface. Conveniently, the air blower is mounted to the furniture bottom wall and directed so as to create a flow of air towards the furniture second wall.

Optionally, the air circulating device further comprises a first and a second pair of containing flanges; the first pair of containing flanges extending from the furniture first peripheral wall, the first pair of containing flanges being in a generally parallel relationship relative to each other and extending in a direction so as to guide the flow of air between the enclosure peripheral wall and the furniture first peripheral wall; the a second pair of containing flanges extending from the furniture bottom wall, the second pair of containing flanges being in a generally parallel relationship relative to each other and extending in a direction so as to guide the flow of air between the enclosure floor and the furniture bottom wall.

Advantages of the present invention include that the proposed air circulation device and method is specifically adapted to reduce temperature stratification. The proposed method and device allows for reduction in the temperature stratification without creating a significant increase in energy consumption and with reduced risks of discharging warm air in areas wherein it is not suitable to do so. Furthermore, the proposed method and device uses existing furniture within the room to provide an energy efficient and elegant solution to the problem of temperature stratification. The proposed method is thus relatively inexpensive since it uses already existing objects as part of the solution.

Other objects and advantages of the present invention will become apparent from a careful reading of the detailed description provided herein, within appropriate reference to the accompanying drawings.

BRIEF DESCRIPTION OF THE DRAWINGS

Embodiments of the invention will now be disclosed, by way of example, in reference to the following drawings in which.

DETAILED DESCRIPTION OF THE PREFERRED EMBODIMENTS

With reference to the annexed drawings the preferred embodiments of the present invention will be herein described for indicative purpose and by no means as of limitation.

Figure 1:
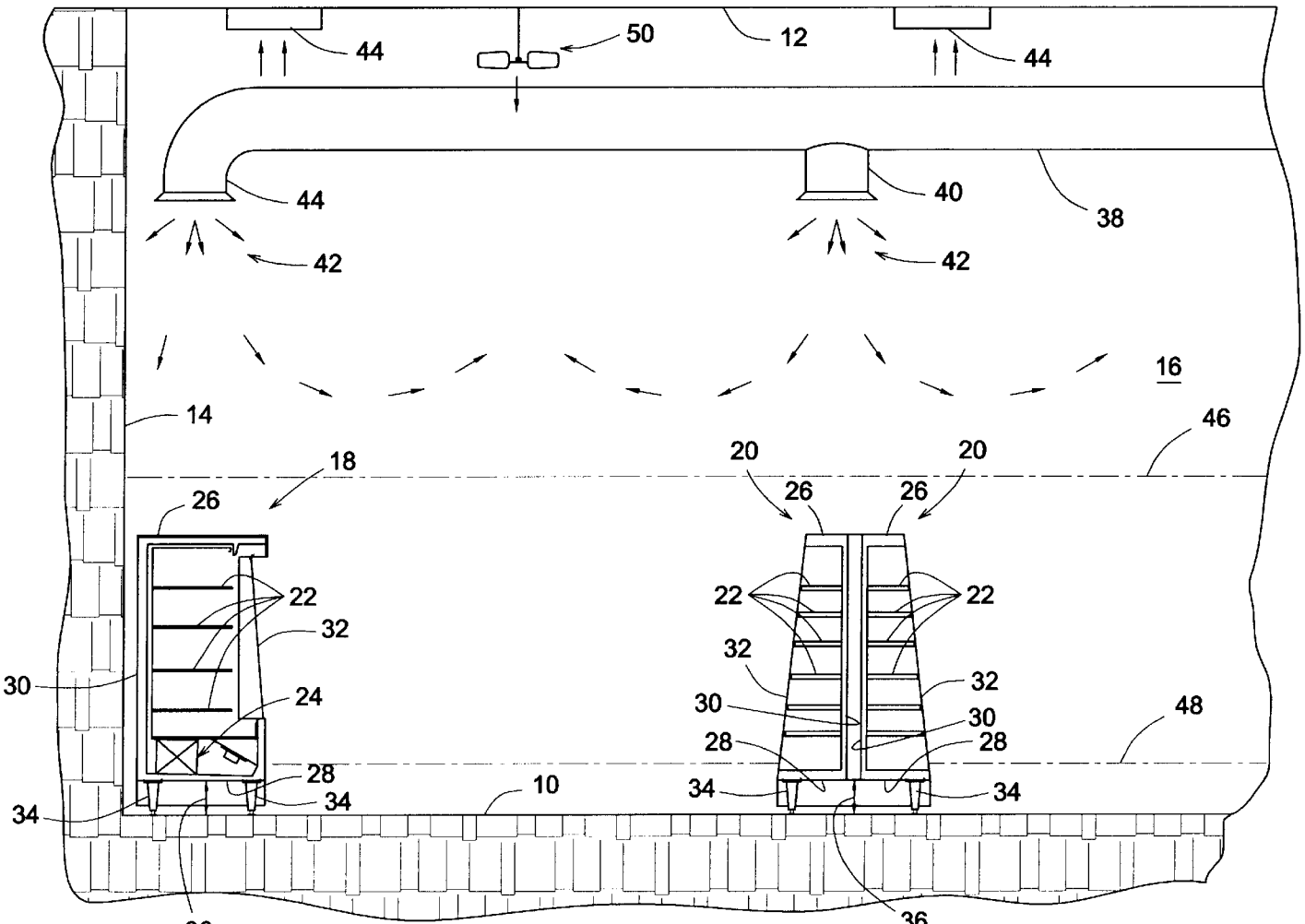
FIG.1 (Prior Art)
FIG. 1, in a schematic partial elevational view with sections taken out, illustrates a conventional air circulating device and method typical of the prior art mounted within a room, the room being furnished with furniture contained therein and being supplied by conventional ventilating ducts having conventional air diffusers attached thereto.
Figure 2:
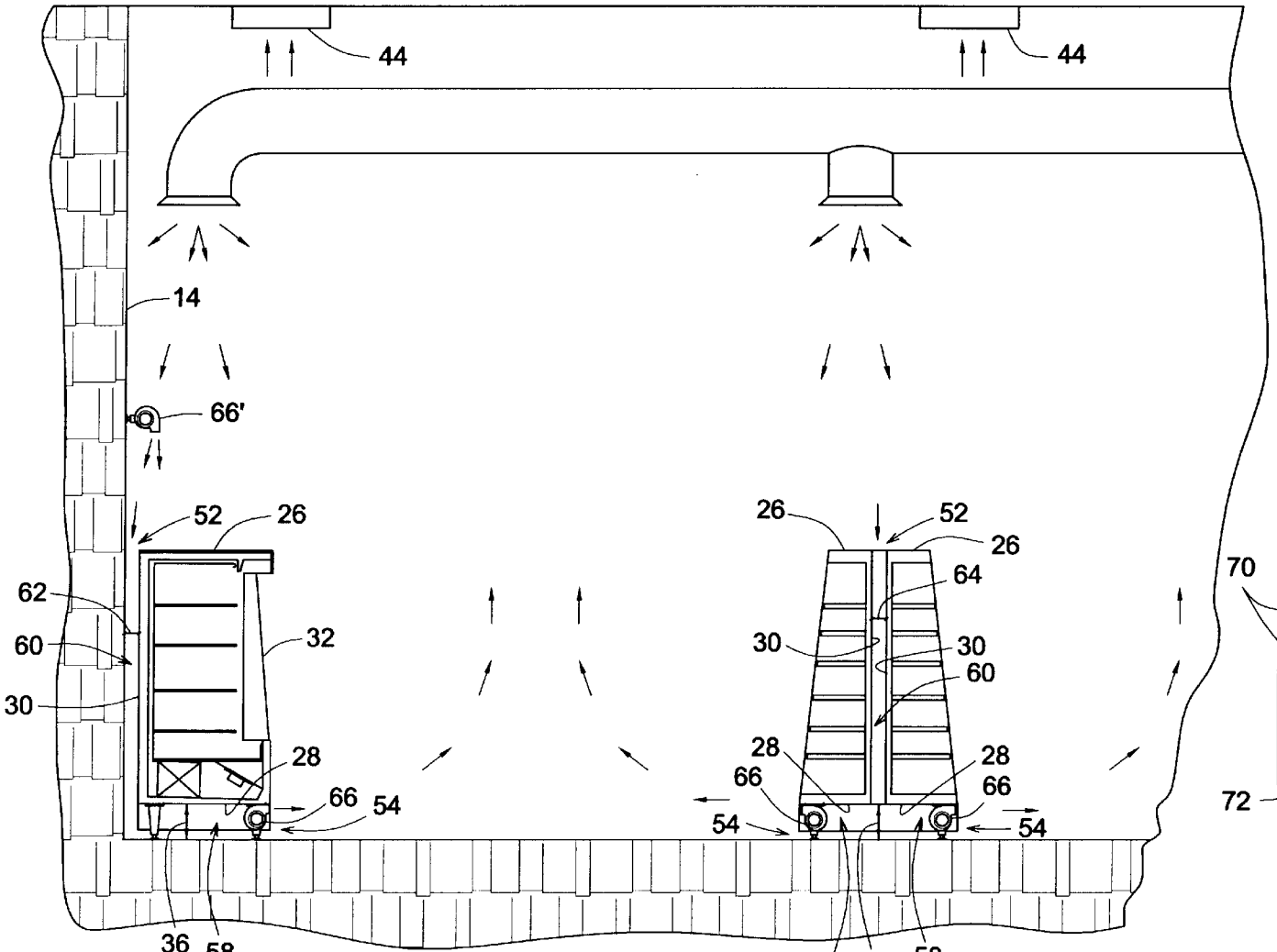
FIG. 2, in a partial elevational view with sections taken out, illustrates an air circulating device in accordance with an embodiment of the present invention mounted within a room, the room being provided with a conventional ventilating duct having conventional diffusers attached thereto.

Referring to FIG. 1, there is shown an enclosure such as a room delimited by a room floor 10, a room ceiling 12 and a room peripheral wall 14 (only a section of which is shown in FIGS. 1 and 2). The room defines an inner volume 16 filled with air.

The room is furnished with objects such as pieces of furniture. In the example illustrated in FIGS. 1 and 2, the pieces of furniture include a refrigerated display unit 18 and a pair of display shelf units 20 mounted in a back-to-back relationship relative to each other. Both the refrigerated display unit 18 and the display shelf units 20 include display shelves 22 for supporting and displaying articles such as food products to be sold. The refrigerated display unit 18 further includes a refrigerating system incorporating a compressor unit schematically illustrated and indicated by the reference numeral 24.

Each piece of furniture defines a furniture top surface 26, a furniture bottom surface 28, a furniture first peripheral surface 30 and an opposed furniture second peripheral surface 32.

Each piece of furniture 18, 20 is preferably provided with a floor-to-furniture spacing means for spacing the furniture bottom surface 28 from the room floor 10. Typically, the floor-to-furniture spacing means includes a set of furniture legs 34 extending from the furniture bottom surface 28 to the room floor 10. The floor-to-furniture spacing means defines a floor-to-furniture spacing 36 between the furniture bottom surface 28 and the room floor 10.

In the example illustrated in FIGS. 1 and 2, the room is further provided with a conventional ventilating system including a conventional ventilating duct 38 in fluid communication with conventional air diffusers 40. The ventilation system is adapted to provide air exchange within the room so as to meet air exchange requirements and also to provide heated or cooled air as needed for maintaining the temperature within the room at a suitable temperature level.

Typically, the ventilating duct 38 and associated ventilating diffusers 40 are located in a generally close relationship relative to the room ceiling 12. Typically, they are maintained in a generally spaced relationship relative to the room floor 10. For example, the outlet of the diffusers 40 may be located as far as 20 feet or more from the room floor 10.

In certain regions of the world, during the warmer seasons, the ventilating system is used as an air conditioning means for cooling the temperature of the air within the room. The air traveling within the ventilation duct 38 is previously cooled by a suitable air cooling unit. The discharged air 42 discharged by the diffusers 40 is thus at a temperature level substantially lower than that of the air contained within the room.

Since colder air has a higher density, the discharged velocity at the outlet of the diffusers 40 is typically sufficient to allow the air to reach a location adjacent the floor 10. The warmer air adjacent the room floor 10 is displaced by the cold air and circulates upwardly because of its lower density towards the room ceiling 12. It is allowed to flow into the air return inlet 44 located adjacent the room ceiling 12. From the air return inlets 44, it is recycled in the air conditioning system.

Hence, when the ventilating system is used as an air conditioning system for cooling the air within the room, the discharge velocity of the discharged air 42 being discharged from the diffusers 40 is typically sufficient to allow for blending of the various air temperatures within the room and for cooling of the latter.

In certain regions of the world, during colder periods, the ventilating system discharges into the room by the diffusers 40 air that has been previously warmed by an air heating unit such as a furnace or the like.

When the air 42 discharged by the diffusers 40 is at a higher temperature than the air contained within the room, the discharge velocity at the diffuser outlet is often not sufficient to compensate for the density differential between the density of the warmed air and that of the colder air. After being discharged, the flow of warm air adjacent the diffuser tends to spread horizontally before being pulled upwardly by the density gradient. The warm air does not reach the lower region of the room. Accordingly, a temperature differential, stratification or gradient occurs within the room. The problem is further compounded in situations, for example, wherein refrigerated display units such as the refrigerated display unit 18 are present in the room since the temperature of the air adjacent the furniture second surface 32 is cooled by the refrigerating system of the refrigerating unit 18.

As a result of the air temperature stratification within the room, the air temperature distribution defines a first initial air temperature level and a second initial air temperature level. The first initial air temperature level is located above the second initial air temperature level. In the example illustrated in FIGS. 1 and 2, the first initial air temperature level is indicated by the axis line 46 while the second initial air temperature level is indicated by the axis line 48. Because of the air temperature stratification, the temperature of the air is higher at the first initial air temperature level than at the second initial temperature level.

FIG. 1 illustrates a conventional prior art method for attempting to reduce the temperature stratification within the room. The conventional prior art method involves the use of a prior art air circulating device in the form of a prior art fan 50 mounted adjacent the room ceiling 12. As mentioned previously, this type of prior art device has proven to be unsatisfactory and has been associated with various drawbacks including increased noise, increased energy consumption and lack of efficiency.

Furthermore, warm air blown by the fan 50 could be unwantingly directed towards the furniture first surface 32 of a refrigerated display unit 18. In such instances, it may increase the energy consumption of the refrigerated display unit 18 and/or be detrimental to the refrigerated items contained therein.

Referring now more specifically to FIG. 2, there is shown one of the air ventilating devices in accordance with embodiments of the present invention and the results of applying the steps of the proposed air ventilation method also in accordance with the present invention. The proposed method includes the step of positioning at least one piece of furniture such as a refrigerated display unit 18, a display shelf unit 20 or the like within the room or enclosure so as to create air circulating conduits defining a circulating conduit peripheral wall.

The piece of furniture is positioned so that the furniture first peripheral surface 30 forms at least part of the air-circulating conduit. The air circulating conduit is configured, sized and positioned so as to define a circulating conduit inlet 52 positioned adjacent the first initial air temperature level 46 and a circulating conduit outlet 54 positioned adjacent the second initial air temperature level 48.

Typically, the piece of furniture is positioned within the enclosure so that the furniture bottom surface 28 is spaced relative to the room floor 10 and so that the floor-to-furniture spacing 36 forms a conduit first segment 58 extending in a generally horizontal orientation and being located substantially adjacent the room floor 10.

As is shown on the left-hand side of FIG. 2, in order to allow the furniture second peripheral surface 32 to form part of the circulating conduit peripheral wall, the piece of furniture may be positioned adjacent a section of the room peripheral wall 14. Alternatively, as illustrated on the right-hand side of FIG. 2, the furniture second peripheral wall 32 may be positioned adjacent any other structure such as a similar piece of furniture. The furniture first peripheral wall 30 is thus positioned either adjacent the room peripheral wall 14 or adjacent another structure so as to form a generally vertically oriented circulating conduit second segment 60 extending from the circulating conduit inlet 52 to the conduit first segment 58.

The piece of furniture, when positioned adjacent the room peripheral wall 14, defines a room peripheral wall-to-furniture first peripheral wall spacing 62 therebetween. The room peripheral wall-to-furniture first peripheral surface spacing 62 is adapted to form the air conduit first segment 60 extending between the air conduit inlet 52 and the conduit first segment 58 and is in fluid communication with the latter.

When the piece of furniture is positioned adjacent a second piece of furniture such as exemplified in the right-hand side of FIG. 2, the piece of furniture defines a second piece of furniture-to-furniture first peripheral surface spacing 64 (or a third peripheral surface when the two pieces of furniture are merged to make only one). The second piece of furniture-to-furniture first peripheral surface spacing 64 is adapted to form the air conduit second segment 60 extending between the circulating conduit inlet 52 and the conduit first segment 58.

Preferably, the circulating conduit inlet 52 is positioned substantially in register with one of the air diffusers 40 so as to take advantage of the discharge velocity at the discharge of the corresponding air diffuser 40.

Typically, the flow of air within the circulating conduit is induced by providing and air blower or fan positioned within the circulating conduit or adjacent the latter. Preferably, as illustrated in FIG. 2, an air blower 66 is mounted in the floor-to-furniture spacing 36 typically adjacent the circulating conduit outlet 54. Typically, the air blower 66 is attached to the furniture bottom surface 28.

Alternatively, as illustrated on the left-hand side of FIG. 2, the air blower 66 may be positioned adjacent the circulating conduit, for example, attached to the room peripheral wall 14 as indicated by arrow 66'.

Figure 3:
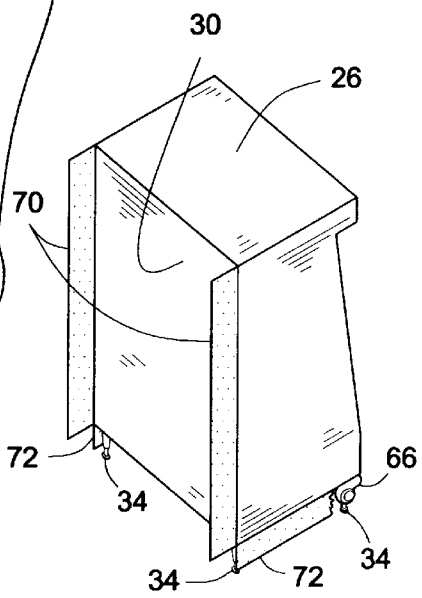
FIG. 3, in a partially sectioned back perspective view, illustrates an embodiment of an air circulating device in accordance with the present invention that includes pairs of containing flanges oriented so as to further direct the flow of air within the air circulating conduit between the air circulating device and the wall and floor of the room enclosure.

Optionally, as illustrated in greater details in FIG. 3, both the furniture first peripheral surface 30 and the furniture bottom surface 28 may be provided with a first and a second pair of containing flanges 70, 72. The containing flanges 70, 72 typically extend respectively from the furniture first peripheral surface 30 and the furniture bottom surface 28 adjacent their respective lateral or peripheral edges. Both the containing flanges 70, and 72 are grouped in pairs of flanges that extend in a generally parallel relationship relative to each other.

The first and second pairs of containing flanges 70, 72 are respectively oriented so as to further direct the flow of air within the conduit second and first segments 60, 58. Accordingly, the first pair of containing flanges 70 defines containing flanges 70 that are positioned and oriented so as to guide the flow of air between the enclosure peripheral wall 14 and the furniture first peripheral wall 30. Similarly, the second pair of containing flanges 72 defines containing flanges 72 that are positioned and oriented so as to guide the flow of air between the room floor and the furniture bottom surface.

In use, the warm air emanating from the diffuser 40 is drawn into the circulating conduit inlet 52 by the air blower 66 or 66'. The warm air flows downwardly in the circulating channel second segment 60 and substantially horizontally into the circulating channel first segment 58 before being discharged at the circulating channel outlet 54. The warm air from the first initial temperature level 46 is thus discharged at the second initial air temperature level 48 warming the latter.

The air is preferably discharged substantially horizontally and away from the furniture second surface 32 as indicated by arrow 68. The temperature immediately adjacent the furniture second surface 32 is therefore not affected and, the energy consumption of the refrigerated display unit 18 as well as the content therein are also not affected.

Although the present air circulating method and device have been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A method for circulating the air contained within an enclosure so as to reduce the vertical air temperature stratification of said air, said air temperature stratification defining a first initial air temperature level and a second initial air temperature level, said first initial air temperature level being located above said second initial air temperature level, the temperature of said air being higher at said first initial air temperature level than at said second initial air temperature level, said enclosure defining an enclosure ceiling, an enclosure floor and enclosure peripheral wall, said enclosure having a piece of furniture contained therein, said piece of furniture defining a furniture top surface, a furniture bottom surface, a furniture first peripheral surface and a generally opposed furniture second peripheral surface, said method comprising the steps of:

a) positioning said piece of furniture within said enclosure so as to create an air circulating conduit defining a circulating conduit peripheral wall; said piece of furniture being positioned so that said furniture first peripheral surface forms at least part of said air circulating conduit, said air circulating conduit being configured, sized and positioned so as to define a circulating conduit inlet positioned adjacent said first initial air temperature level and a circulating conduit outlet positioned adjacent said second initial air temperature level;

b) inducing a flow of air in said circulating conduit so as to force said air adjacent said first initial air temperature level to flow into said circulating conduit inlet and to be discharged at said circulating conduit outlet.

2. A method as recited in claim 1, wherein the positioning of said piece of furniture includes raising said furniture bottom surface from said room floor so as to create a floor-to-furniture spacing therebetween, said floor-to-furniture spacing defining a first air conduit segment extending between said furniture first and second surfaces adjacent to said room floor.

3. A method as recited in claim 1, wherein said piece of furniture is positioned adjacent a section of said room peripheral wall in a spaced relationship relative to the latter so as to define a room peripheral wall-to-furniture first peripheral wall spacing therebetween, said room peripheral wall-to-furniture first peripheral wall spacing defining a generally vertical air conduit second segment extending from said air conduit inlet to said air conduit first segment and being in fluid communication with the latter.

4. A method as recited in claim 1, wherein said piece of furniture is positioned adjacent a second piece of furniture in a spaced relationship relative to the latter so as to define a second piece of furniture-to-furniture first peripheral surface spacing therebetween, said second piece of furniture-to-furniture first peripheral surface spacing defining a generally vertically oriented air conduit second segment, said air conduit second segment extending from said air conduit inlet to said air conduit segment and being in communication with the latter.

5. A method as recited in claim 1, wherein said room is provided with an air diffuser positioned adjacent said room ceiling and wherein said piece of furniture is positioned so that said circulating conduit inlet is substantially in register with said diffuser.

6. A method as recited in claim 1, wherein the flow of air is induced by providing and air blower in said circulating conduit.

7. A method as recited in claim 6, wherein said air blower is positioned in said floor-to-furniture spacing.

8. A method as recited in claim 1, wherein said air blower is positioned adjacent said circulating conduit outlet.

9. A method as recited in claim 8, wherein said air blower is attached to said furniture bottom wall.

10. A method as recited in claim 2, wherein said flow of air is induced by providing an air blower adjacent said circulating conduit.

11. An air circulating device for circulating the air contained within an enclosure, said enclosure defining an enclosure ceiling, an enclosure floor and an enclosure peripheral wall, said air circulating device comprising:

a piece of furniture, said piece of furniture defining a furniture peripheral surface including a furniture top wall, a furniture bottom wall, a furniture first peripheral wall and a furniture second peripheral wall;

a floor-to-furniture spacing means for spacing said furniture bottom wall from said floor; and an air blower attached to said furniture for blowing air in a direction substantially parallel to one of the walls of said furniture peripheral surface.

12. An air circulating device as recited in claim 11, wherein said air blower is mounted to said furniture bottom wall and directed so as to create a flow of air towards said furniture second wall.

13. An air circulating device as recited in claim 11, wherein said air blower is positioned adjacent said furniture second wall.

14. An air circulating device as recited in claim 11, further comprising a first pair of containing flanges extending from said furniture first peripheral wall, said first pair of containing flanges being in a generally parallel relationship relative to each other and extending in a direction so as to guide the flow of air between said enclosure peripheral wall and said furniture first peripheral wall.

15. An air circulating device as recited in claim 11, further comprising a second pair of containing flanges extending from said furniture bottom wall, said second pair of containing flanges being in a generally parallel relationship relative to each other and extending in a direction so as to guide the flow of air between said enclosure floor and said furniture bottom wall.

16. An air circulating device as recited in claim 11, further comprising a first and a second pair of containing flanges; said first pair of containing flanges extending from said furniture first peripheral wall, said first pair of containing flanges being in a generally parallel relationship relative to each other and extending in a direction so as to guide the flow of air between said enclosure peripheral wall and said furniture first peripheral wall; said a second pair of containing flanges extending from said furniture bottom wall, said second pair of containing flanges being in a generally parallel relationship relative to each other and extending in a direction so as to guide the flow of air between said enclosure floor and said furniture bottom wall.

17. An air circulating device for reducing temperature stratification within an enclosure, said enclosure defining an enclosure peripheral wall, an enclosure floor and an enclosure ceiling, said enclosure including an air heating system with at least one diffuser proximate to the enclosure ceiling, said air circulating device being located within said enclosure so as to define an air circulating conduit therebetween, said air circulating device comprising:

opposite first and second device peripheral walls, said first device peripheral wall being located relative to said enclosure peripheral wall so as to define a first segment of said air circulating conduit with said enclosure peripheral wall, said first segment defining upper and lower ends, said upper end being in fluid communication with the enclosure;

a device bottom wall between said first and second device peripheral walls, said device bottom wall being located relative to the enclosure floor so as to define a second segment of the air circulating conduit with the enclosure floor, said second segment defining first and second ends adjacent said first and second device peripheral walls, respectively, said first and second ends of the second segment are in fluid communication with the first segment of the air circulating conduit and with the enclosure, respectively; and an air blower secured to said device along said air circulating conduit for circulating air therethrough, from the upper end of the first segment to the second end of the second segment; whereby hot air coming out from the diffuser of the enclosure is circulated down to a colder lower region of the enclosure and away from the second device peripheral wall.

18. The air circulating device of claim 17, including third device peripheral wall, said third device peripheral wall being generally parallel to and in a generally spaced relationship with the first device peripheral wall so as to define the first segment of the air circulating conduit with the first device peripheral wall.

* * * * *